United States Patent [19]

Sellera

[11] 4,077,119

[45] Mar. 7, 1978

[54] SHAVING DEVICE

[76] Inventor: Jose Manuel Sellera, 721 SW. 2 St., Miami, Fla. 33130

[21] Appl. No.: 769,185

[22] Filed: Feb. 16, 1977

[51] Int. Cl.[2] ..... B26B 21/44

[52] U.S. Cl. ..... 30/41

[58] Field of Search ..... 30/41, 86, 90

[56] References Cited

U.S. PATENT DOCUMENTS

| | | | |
|---|---|---|---|
| 2,866,265 | 12/1958 | Kells | 30/41 |
| 2,940,641 | 6/1960 | Norrish et al. | 30/41 X |
| 3,176,391 | 4/1965 | Resnick et al. | 30/41 |
| 3,726,009 | 4/1973 | Hackmyer | 30/41 |
| 4,023,269 | 5/1977 | Lopez | 30/41 |

*Primary Examiner*—Robert C. Watson

[57] ABSTRACT

A shaving device which includes a holder for a razor blade and which holder has a receptacle in a handle for holding a pressurized container with an exteriorly operable button to release shaving cream for passage through a channel in the holder to the head end which includes guide tracks for hooked up engagement with a razor blade carrier so that when the button is depressed shaving cream is released onto the surface being shaved.

5 Claims, 2 Drawing Figures

SHAVING DEVICE

FIELD OF THE INVENTION

This invention relates to a razor blade holder and more particularly to a razor blade holder of the type which includes a supply of shaving cream to be dispensed for use in shaving.

BACKGROUND OF THE INVENTION

In the past there have been numerous types of devices for use in shaving. This invention is of such a device. More specifically, this invention is of a device to which a shaving blade may be fixed at one end and from which end a handle extends which is hollow and in which there is captivated a dispenser for shaving cream having a exteriorly accessible button to operate and release shaving cream for passage through a channel to be released on the surface being shaved in advance of the blades movement when the device is being manipulated.

It is accordingly an object of this invention to provide an improved shaving device of the type described which is simple and inexpensive to manufacture, adapted to be transported readily, and which provides a conveniently arranged combination for use in shaving without the need for additional devices.

DESCRIPTION OF THE PREFERRED EMBODIMENT

Figure 1:
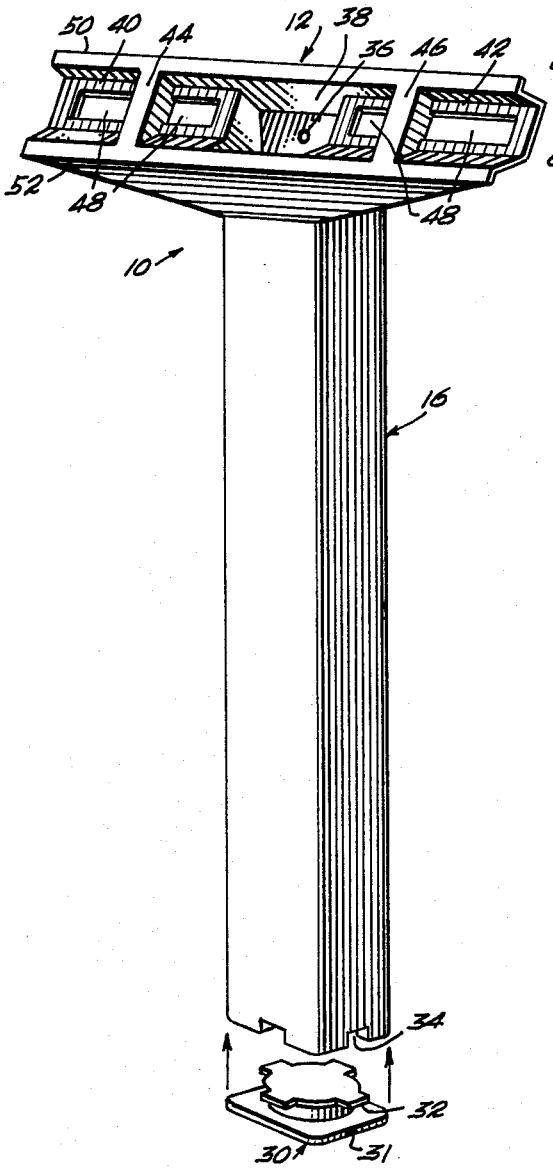
FIG. 1 is a partially exploded view of the holder of the instant invention.
Figure 2:
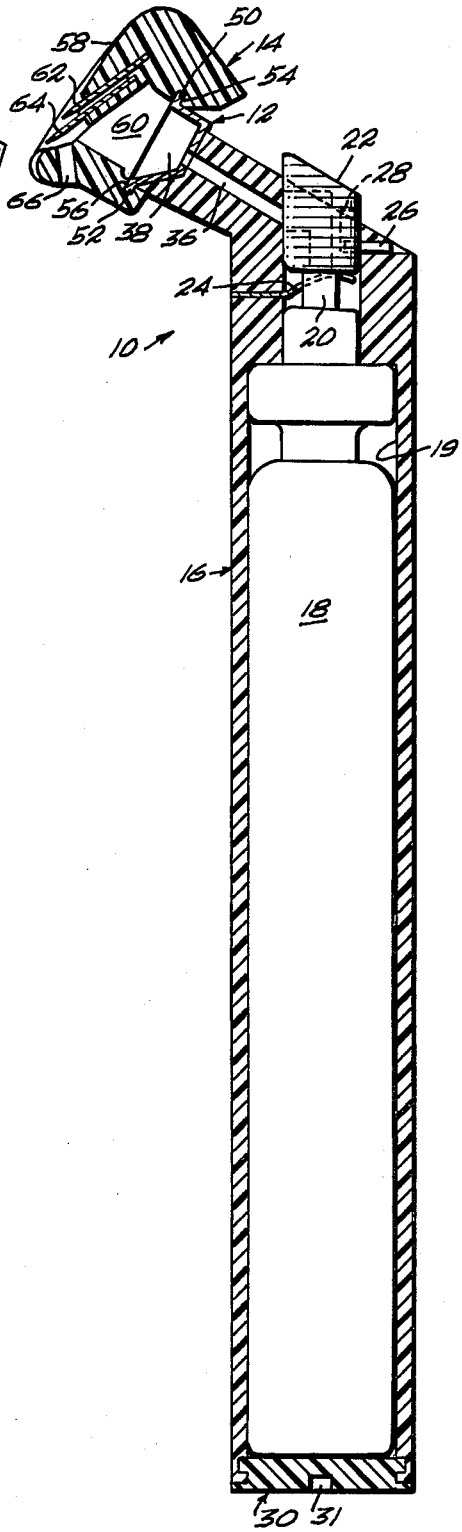
FIG. 2 is a view of the holder in cross section in combination with a dispensing container of shaving cream captivated within the handle of the holder and to which a razor blade and body supporting the blades in a cutting attitude are removably arranged on one end of the shaving device.

Referring to the drawings wherein like reference characters designate like or corresponding parts throughout the several views there is shown a razor blade holder and container carrier which is generally designated by the numeral 10. It is provided with an upper end 12 with track means to which a razor blade 62 and preferably a pair including the blade 64 are fixed in a cutting attitude in a body 14 provided with guide tracks such as 50 and 52 which companionately engage in grooves 54 and 56 in the head or end 12. The holder includes a hollow stem 16 which has side walls defining an elongate chamber 18 bounded by the interior of side walls 19. The handle is open at the lower end 34 and the chamber is adapted to be sealed by a cap 30 which is provided with a cover plate 31 and an axially extending portion with terminally outwardly radially extending fins 32 for hooked up engagement in the recess of the end 34 as shown at the lower portion of FIG. 2. Within the chamber 19 a pressurized container of shaving cream is secured, which for convenience is designated by the numeral 18 and occupies the space in the chamber between the side walls 19. The vessel or container includes an upwardly extending portion 20 comprising a valve stem with a cap 22 which is exteriorly accessible, the cap being biased upwardly by a leaf spring 24 captivated in the side wall and in engagement with the lower portion of the upper end urging it into the position shown in FIG. 2. Through the upwardly opening hole designated by the numeral 28 the cap may be depressed downwardly so that a pin 26 captivated in the side wall moves between to stop positions in an axial groove which limits axial movement. Through the container top there is a channel through which shaving cream is adapted to pass under pressure when the cap 22 is pressed downwardly, the shaving cream moving up the channel designated by the numeral 36 and into the groove 38 passing through the holes such as 48, see FIG. 1 and into the elongate space or void generally designated by the numeral 60 but also including the space 40 and 42 as well as 38 between the webs 44 and 46 which terminate at upper surfaces generally in the same plane as the aforementioned guide tracks 50 and 52 whereby the shaving or soapy material is constrained to passage about the blades and downwardly through the opening 66. In the preferred embodiment the guide tracks are adapted to hold a conventional shaving blade of the type commonly known as the Gillette Trac II. In use, one merely presses the button as shaving is done to dispense an appropriate amount of shaving cream. It is seen that, by reason of this invention, it is not required to carry shaving cream and a great deal of paraphernalia for shaving such as when a traveler is away from home but, on the other hand, all the required equipment is located in a small compact package.

I claim:

1. A razor blade holder which comprises an elongate stem having a head end and a holder end and an axially extending longitudinally aligned receptacle open at the terminal end of said holder end, a container of shaving cream under pressure in the container, said container being sized to fit within the receptacle, and means to close the container at said terminal end, said container including a valve and an operator knob to open and close the valve, and said holder having an opening sized for passage of said operator knob, said knob being exteriorly accessible, and said container having a discharge mouth and said holder having a passageway leading to said head end from said discharge mouth, a razor blade carrier means comprising a piece having a first open end and a second open end, said head having a discharge opening and said razor blade carrier means and said head end including mutually intercooperating means to connect and disconnect said razor blade carrier in spanning and covering relation of said discharge opening for passage of shaving cream to the head end of the holder and through the piece and out said second opening, and a razor blade fixed to said carrier and spanning said second opening so that the shaving cream is constrained to pass through the second opening and around the blade when said valve is operated, said piece and said head end being of an openwork structure defining openings in fluid communication with said passageway.

2. The device as set forth in claim 1 wherein the means to close comprises a cap.

3. The device as set forth in claim 1 wherein spring means are provided normally holding said valve in a closed position.

4. The device as set forth in claim 3 wherein the handle and operator knob include mutually intercooperating means to limit movement of the knob between a valve open and a valve closed position.

5. The device as set forth in claim 4 wherein the operator knob is axially movable.

* * * * *